US006153840A

United States Patent [19]

Dreher

[11] Patent Number: 6,153,840

[45] Date of Patent: Nov. 28, 2000

[54] REDUCED NOISE ELECTRICAL SWITCH

[75] Inventor: Regine Dreher, Spaichingen, Germany

[73] Assignee: Marquardt GmbH, Rietheim-Weilheim, Germany

[21] Appl. No.: 09/218,457

[22] Filed: Dec. 22, 1998

[30] Foreign Application Priority Data

Dec. 24, 1997 [DE] Germany ..... 197 57 907

[51] Int. Cl.[7] ..... H01H 21/04

[52] U.S. Cl. ..... 200/301; 200/339

[58] Field of Search ..... 200/5 R, 5 A, 200/6 R, 16 R, 17 R, 18, 293, 301, 329, 339, 553, 556, 557

[56] References Cited

U.S. PATENT DOCUMENTS

| | | | |
|---|---|---|---|
| 3,103,570 | 9/1963 | Gibbs | 200/172 |
| 3,246,087 | 4/1966 | Haviland | 200/6 |
| 3,576,958 | 5/1971 | Ohno | 200/1 |
| 4,221,941 | 9/1980 | Genovese | 200/67 A |
| 4,883,932 | 11/1989 | Van Hout et al. | 200/339 |
| 5,027,095 | 6/1991 | McKay et al. | 335/202 |
| 5,107,082 | 4/1992 | Valenzona | 200/292 |
| 5,438,798 | 8/1995 | Plamper et al. | 49/28 |
| 5,749,459 | 5/1998 | Balaban et al. | 200/559 |
| 5,826,710 | 10/1998 | Kurek et al. | 200/559 |

*Primary Examiner*—Michael Friedhofer
*Attorney, Agent, or Firm*—Venable; George H. Spencer; Robert Kinberg

[57] ABSTRACT

An electrical switch comprising: one of a housing and a housing part; a contact system attached to one of the housing and the housing part; an operating member for switching the contact system and arranged so that the operating member can move on one of the housing and the housing part; and at least one damping element, the damping element serving as a sound dampening bumper between the operating member and one of the housing and the housing part, and the damping element is located on at least one of the housing, the housing part and the operating member, and wherein the damping element is of a single unitary piece with at least one of the housing, the housing part and the operating member.

17 Claims, 4 Drawing Sheets

REDUCED NOISE ELECTRICAL SWITCH

CROSS-REFERENCE TO RELATED APPLICATION

This application claims the rights of priority of German Patent Application No. 197 57 907.8 filed on Dec. 24, 1997, the subject matter of which is incorporated herein by reference.

The invention relates to an electrical switch.

Such electrical switches are used, interalia, as control switches in motor vehicles. These switches can possibly also be used in switch arrangements for control panels.

Such switches or switch arrangements, which have been disclosed, for example, in DE 195 48 216 A1, have a housing in which a contact system is held. The contact system may also be assigned to a housing part. An operating member is arranged on the housing or on the housing part, such that it can move. Operation of the operating member causes the contact system to switch.

It has been found that noise can occur when the operating member is operated. In some cases, such noise is undesirable.

The invention is based on the object of developing electrical switches of the type mentioned initially in such a manner that the amount of noise produced when the switch is operated is reduced.

BRIEF SUMMARY OF THE INVENTION

This object is achieved by a switch according to the invention which has a damping element. The damping element forms a stop for the movement of the operating member, in such a manner that the noise from the operating member striking against the housing of the switch is damped. Further refinements of the invention are the subject matter of the dependent claims.

The damping element may be designed as an elastic element. The damping element may be composed of rubber or an elastomer or the like. In general, the housing or the housing part of the switch is produced from plastic. The damping element can thus also be composed of a plastic which is softer than the housing or the housing part.

The damping element can be produced as a separate part, subsequently being attached to the housing or to the housing part and/or to the operating member. The housing, the housing part or the operating member then expediently has a recess, in which the damping element is inserted. In order to achieve secure attachment, the damping element can have an approximately I-shaped cross section in a section plane, and can have a shape offset in the form of a step with a respectively reduced cross section in a section plane at right angles thereto. The recess is designed to correspond approximately to the cross section of the damping element, so that the damping element latches in when it is inserted into the recess. The upper part of the damping element projects out of the recess and projections in the form of spikes can also be located on the upper part.

The damping element can also just as well be formed integrally with the housing or the housing part and/or the operating member. In this case it is possible for the housing or the housing part and/or the operating member to be produced together with the damping element, using the two-components injection-molding process.

The switch according to the invention is particularly suitable for use in a switch arrangement which is used for a control panel of a motor vehicle, for an input panel on an electrical appliance or the like. In this switch arrangement, the contact system can be designed as a separate switching module.

At least one switching module is arranged inside a housing part of the switch arrangement designed as a frame. An operating member designed as a rocker is mounted on the frame such that it can rotate. The damping element is once again located on the frame.

Furthermore, the frame can be designed to be approximately rectangular with two respectively mutually opposite longitudinally and transverse sides as well as rounded corners. Two bearing pins are arranged approximately in the center of the longitudinal sides of the frame. The rocker is mounted on the bearing pins such that it projects over the frame. One damping element is in each case located approximately centrally on each transverse side of the frame, to be precise in particular on a circumferential edge of the frame.

The advantages achieved by the invention are, in particular, that the movement of the operating member during switching is elastically braked. This effectively reduces the noise when the operating member strikes against the housing. The user is also provided with an improved switching sensation, so that the ergonomics of the switch are improved. Even if the switch is operated roughly, damage to the housing of the switch is effectively prevented.

BRIEF DESCRIPTION OF THE DRAWINGS

Exemplary embodiments of the invention are illustrated in the drawings and are described in more detail in the following text. In the figures.

DETAILED DESCRIPTION OF THE INVENTION

Figure 1:
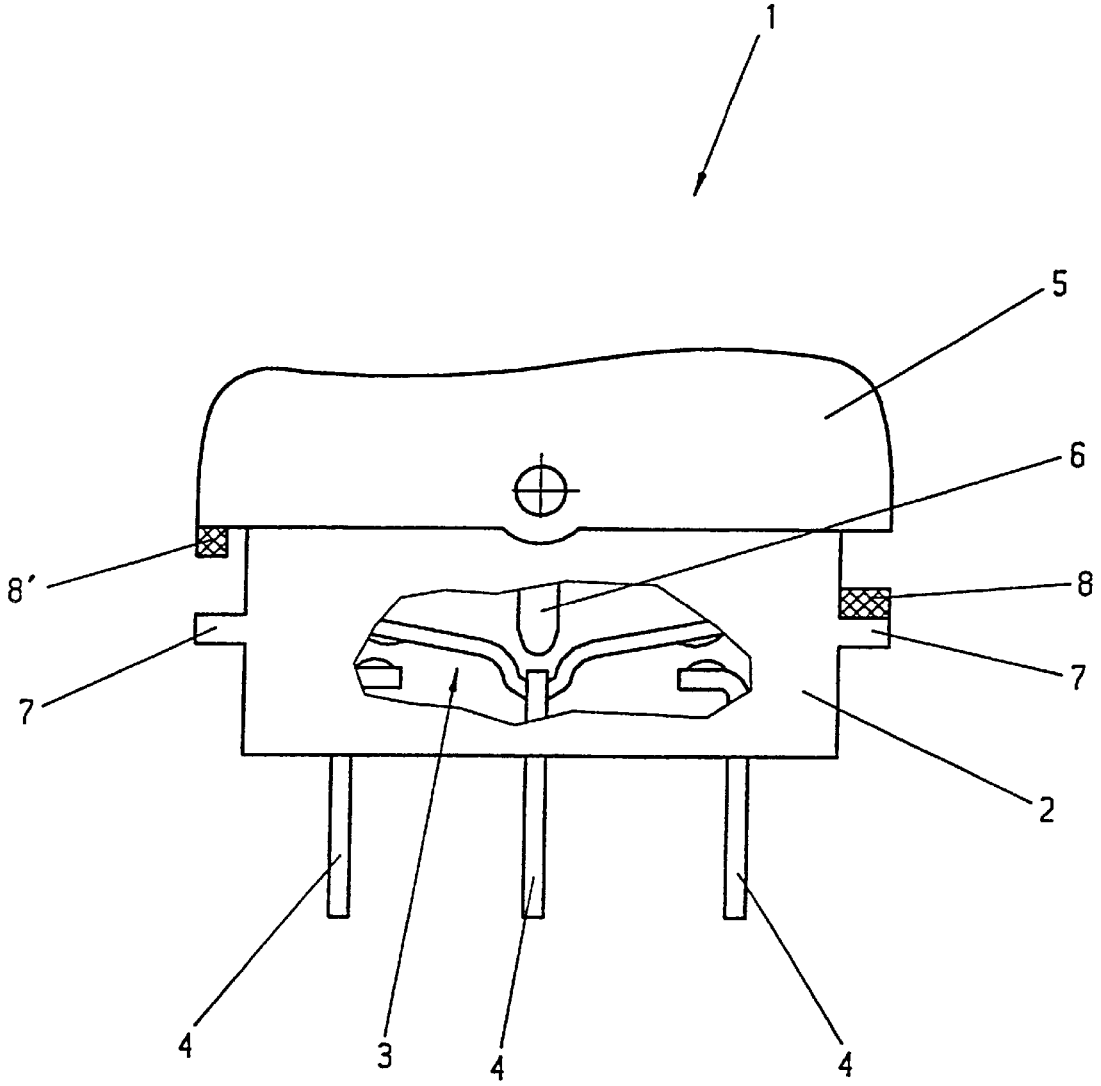
FIG. 1 shows a side view of an electrical switch whose housing is shown partially cut away.

An electrical switch 1 can be seen in more detail in FIG. 1. The switch 1 has a housing 2 in which a contact system 3 is held. The contact system 3 is electrically connected to electrical connections 4 which project out of the housing 2. An operating member 5 is arranged on the housing 2 such that it can move. In the present case, the operating member 5 is a rocker. When it is operated, the operating member 5 has, for example, a switching pin 6 by means of which it acts on the contact system 3 in such a manner that the contact system 3 can be switched over between at least two switching states.

Figure 2:
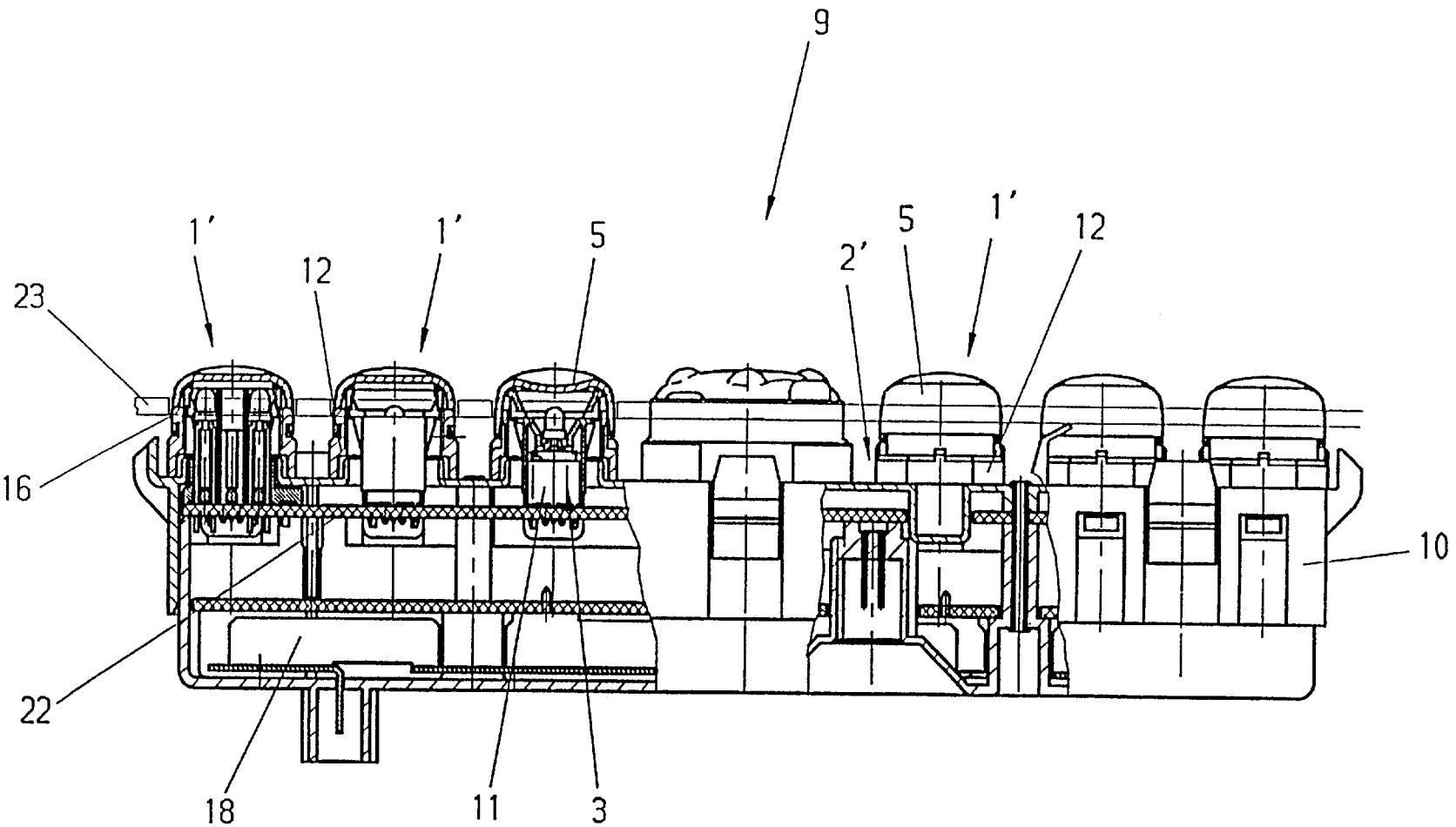
FIG. 2 shows a switch arrangement, shown partially cut away, having a plurality of switches.

It is equally possible for the contact system 3 to be assigned just to a housing part 2', which will be explained in more detail below with reference to a further exemplary embodiment. Such a housing part 2' may be, for example, a frame 12, as is shown in FIG. 2, which surrounds the contact system 3. The rocker, as the operating member 5, is then attached to the frame 12 such that it can rotate.

When the operating member 5 is operated by the user, then it can be seen that the operating member 5 can in this case strike against the housing 2 or against the housing part 2'. For example, as can be seen in FIG. 1, the housing 2 may have a circumferential edge 7 with which the operating member comes into contact during movement for operation. In consequence, a striking noise is once again audible and, in some circumstances, may be undesirable.

In order to reduce or else overcome the striking noise, a damping element 8 is arranged on the housing 2 or on the housing part 2'. The damping element 8 forms a stop for the movement of the operating member 5, in such a manner that the noise of the operating member 5 striking against the housing 2 or against the housing part 2' is damped. The damping element 8 is normally attached to the edge 7 of the housing 2, as can be seen on the right-hand side of the switch 1 in FIG. 1. It is, of course, also possible for the damping element 8' to be arranged on the operating member 5, as is shown on the left-hand side of the switch 1 in FIG. 1. In some cases, it may even be possible to arrange a damping element 8, 8' respectively on the operating member 5 and on the housing 2 or on the housing part 2'. This allows the striking noise to be reduced in a particularly effective manner.

The housing 2 or the housing part 2' is composed of a comparatively hard plastic, for example of polyoxymethylene or polyacetal. The damping element 8, 8' is designed as an elastic element. Rubber, elastomers, thermoplastic elastomers or plastics which are softer than the plastic of the housing 2 are suitable for use as the materials for the damping element 8, 8'. It is, of course, also possible to use other materials which have a noise-damping characteristic for the damping element 8, 8'.

In an further exemplary embodiment, a switch arrangement 9 can be seen in FIG. 2. Such a switch arrangement 9 can be used for a control panel in a motor vehicle. The switch arrangement 9 has a housing 10 for holding at least one electrical switch 1', in the present case a plurality of electrical switches 1'. The operating members 5 of the switches 1' project on the top of the housing 10, the housing 10 being covered there by a flap 23. The housing 10 also contains other electrical, electronic or similar components 18. In particular, a printed circuit board 22 is located in the housing 10. The contact system of the switches 1' is designed as a separate switching module 11. Such switching modules 11 are known per se, for which purpose reference is made, for example, to DE 42 16 454 A1. The switching module 11 is arranged inside a housing part 2' which is designed as a frame 12, and is mounted on the printed circuit board 22 in the housing 10. The operating member 5, which is a rocker, is mounted on the frame 12 such that it can rotate.

Figure 3:
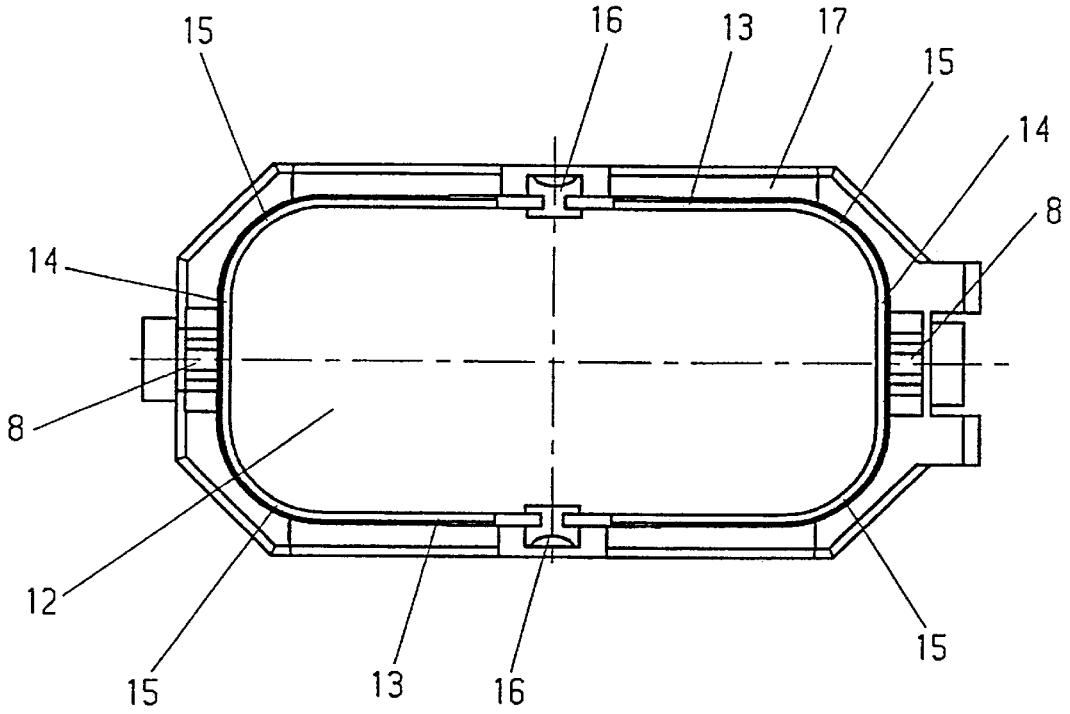
FIG. 3 shows a plan view of a frame from the switch arrangement according to FIG. 2.
Figure 4:
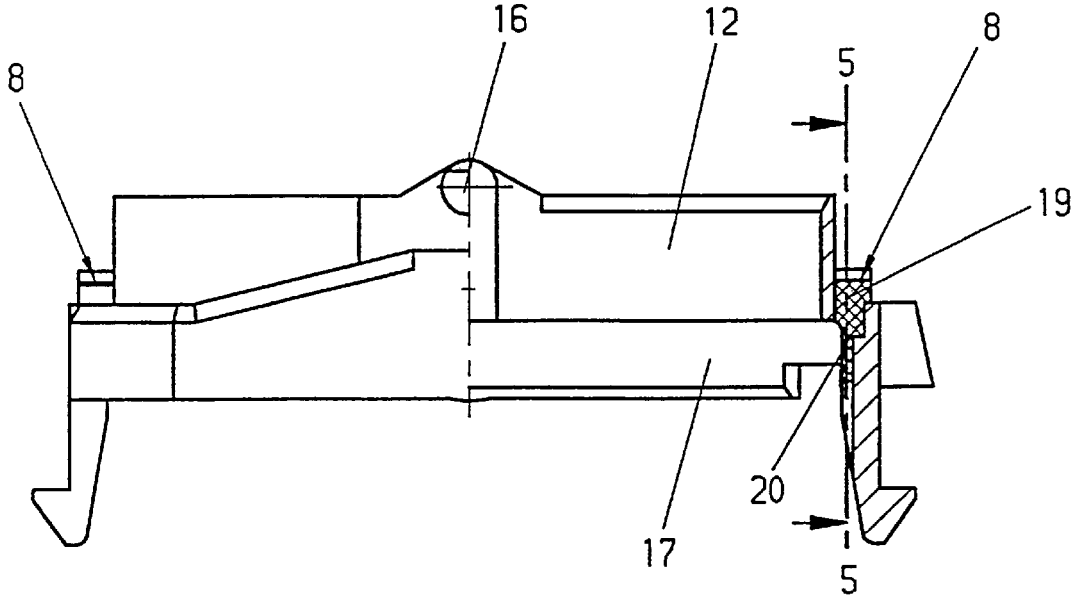
FIG. 4 shows a side view of the frame from FIG. 3, one region being partially shown in section.

The frame 12, a plane view of which is shown in FIG. 3 and a side view of which is shown in FIG. 4, is designed to be approximately rectangular with two respectively mutually opposite longitudinal sides 13 and transverse sides 14. The corners 15 at the junction between the longitudinal sides 13 and the transverse sides 14 may be rounded. Approximately in the center of the longitudinal sides 13 of the frame 12 there are two bearing pins 16, on which the rocker 5 is mounted such that it projects over the frame 12. The damping element 8 is located on the frame 12, to be precise one damping element 8 is in each case arranged approximately centrally on each transverse side 14 of the frame 12. The frame 12 can expediently be provided with a circumferential edge 17, the damping element 8 then being located on this edge 17.

More detailed refinements for the damping element 8, 8' will be explained in more detail in the following text with reference to the damping element 8 which is shown in FIG. 4 and is located on the frame 12. It is self-evident that these configurations can also be used for damping elements 8, 8' which are arranged on the housing 2, on other housing parts 2' of the housing 2, 10, or else on the operating member 5.

In a first refinement, the damping element 8 is produced as a separate part 19, as is illustrated with the damping element 8 which is located on the right-hand side on the frame 12 in FIG. 4. This part 19 is then attached to the frame 12 while the switch 1, 1' is being assembled. A recess 20 is expediently located on the frame 12 for this purpose, in which recess the part 19 is inserted.

Figure 5:
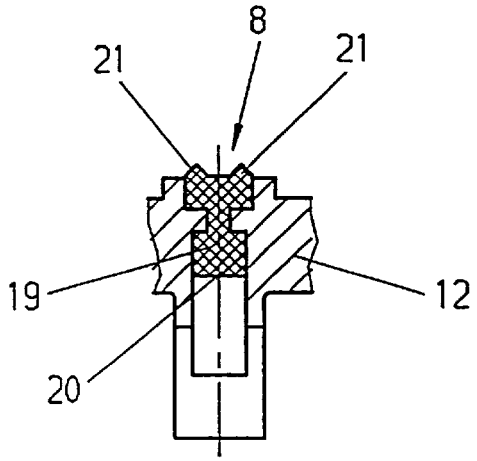
FIG. 5 shows a section along the line 5—5 from FIG. 4.

The part 19, corresponding to the damping element 8, may have an approximately I-shaped cross section in a section plane which can be seen in FIG. 5. The damping element 8 has a shape offset in the form of a step with a respectively reduced cross section in the section plane which can be seen in FIG. 4 and is at right angles to the former section plane. The recess 20 is in turn designed to correspond approximately to the cross section of the damping element 8. This ensures that the damping element 8 latches into the recess 20 during insertion and is attached to the frame 12 in a captive manner.

The upper part of the damping element 8 projects out of the recess 20. This projecting part is used as the actual stop for the operating member 5 during its movement. If required, projections 21 in the form of spikes may be located on the upper part. The easily deformable projections initially brake the movement of the operating member 5 somewhat before it comes to rest against the upper part of the damping element 8. Such a design of the damping element 8 thus ensures that the operating member 5 has a certain amount of subsequent movement.

In a further refinement, which is illustrated on the damping element 8 located on the left-hand side on the frame 12 according to FIG. 4, the damping element 8 is formed integrally with the frame 12. Since the damping element 8 is composed of a different material than the frame 12, it is possible in particular to produce the frame 12 together with the damping element 8 using the two-component injection-molding process.

The invention is not limited to the exemplary embodiments described and shown. In fact, it also covers all specialist developments in the context of the idea of the invention. For example, such a damping element can be used not only for switches for motor vehicles but also on other switches for electrical appliances or the like. In particular, it is possible to equip input panels on electrical appliances with switches which have such a damping element.

What is claimed is:

1. An electrical switch comprising:

one of a housing and a housing part;

a contact system attached to one of the housing and the housing part;

an operating member for switching the contact system and arranged so that the operating member can move on one of the housing and the housing part; and at least one damping element, the damping element serving as a sound dampening bumper between the operating member and one of the housing and the housing part, the damping element being located on at least one of the housing, the housing part and the operating member, wherein the damping element is integrally formed with at least one of the housing, the housing part and the operating member so that the damping element and one of the housing, the housing part and the operating member form a single unitary piece; and wherein the unitary damping element and one of the housing, the housing part and the operating member is produced using the two-component injection-molding process.

2. The electrical switch as disclosed in claim 1, wherein one of the housing and the housing part is made of a first material, the first material comprising plastic, and the at least one damping element is made of a second material, the second material comprising elastic materials.

3. The electrical switch as disclosed in claim 2, wherein the second material of the at least one damping element is softer than the first material and the second material comprises at least one of rubber, an elastomer and a plastic.

4. The electrical switch as disclosed in claim 1, wherein the damping element includes at least one projection formed as a spike and pointing in an approximate direction of at least one of the housing, the housing part and the operating member.

5. An electrical switch comprising:

one of a housing and a housing part;

a contact system attached to one of the housing and the housing part;

an operating member for switching the contact system and arranged so that the operating member can move on one of the housing and the housing part; and at least one damping element serving as a sound dampening bumper between the operating member and one of the housing and the housing part, the damping element attached to at least one of the housing and the housing part and the operating member by being partially inserted into a recess, the damping element having a first cross section and a second cross section at right angles to the first cross section, the first cross section having an I-shape and the second cross section having a step-shape with successively reduced cross-section, and wherein the recess is arranged to correspond approximately to the cross section shapes for gripping the damping element.

6. The electrical switch as disclosed in claim 5, wherein one of the housing and the housing part is made of a first material, the first material comprising plastic, and the at least one damping element is made of a second material, the second material comprising elastic materials.

7. The electrical switch as disclosed in claim 6, wherein the second material of the at least one damping element is softer than the first material and the second material comprises at least one of rubber, an elastomer and a plastic.

8. The electrical switch as disclosed in claim 5, wherein the damping element includes at least one projection formed as a spike and pointing in the approximate direction of at least one of the housing, the housing part and the operating member.

9. An electrical switch comprising:

one of a housing and a housing part;

a contact system attached to one of the housing and the hosing part;

an operating member for switching the contact system and arranged so that the operating member can move on one of the housing and the housing part; and at least one damping element serving as a sound dampening bumper between the operating member and one of the housing and the housing part, the damping element being attached to at least one of the housing, the housing part and the operating member by being partially inserted into a recess, wherein the damping element is a solid element and includes at least one projection formed as a spike and located on an upper part of the damping element that projects from the recess, the at least one projection being easily deformed to initially brake the operating member before the operating member comes to rest against the upper part of the damping element where the operating member is subsequently damped.

10. The electrical switch as disclosed in claim 9, wherein one of the housing and the housing part is made of a first material, the first material comprising plastic, and the at least one damping element is made of a second material, the second material comprising elastic materials.

11. The electrical switch as disclosed in claim 10, wherein the second material of the at least one damping element is softer than the first material and the second material comprises at least one of rubber, an elastomer and a plastic.

12. An electrical switch arrangement comprising:

a housing;

a plurality of electrical switches arranged in the housing;

a switch comprising:

a switching module, including a contact system;

a frame;

an operating member for switching the contact system and arranged as a rocker and pivotally mounted on the frame such that the operating member can rock; and at least one damping element located on at least one of the frame and the operating member, the damping element serving as a sound dampening bumper between the operating member and the frame, wherein the damping element is integrally formed with at least one of the frame and the operating member so that the damping element and one of the frame and operating member form a single unitary piece and wherein the unitary damping element and one of the housing, the housing part and the operating member is produced using the two-component injection-molding process.

13. The electrical switch arrangement as disclosed in claim 12, wherein the frame is approximately rectangular and includes two opposite and substantially parallel longitudinal sides, the longitudinal sides each having a middle;

two opposite and substantially parallel transverse sides, the transverse sides each having a middle;

two bearing pins, the bearing pins each arranged approximately in the middle of each of the longitudinal sides, for rockably mounting the operating member; and wherein at least one of the damping elements is located at approximately the middle of each of the transverse sides.

14. An electrical switch arrangement comprising:

a housing;

a plurality of electrical switches arranged in the housing;

a switch comprising:

a switching module, including a contact system;

a frame;

an operating member for switching the contact system and arranged as a rocker and pivotally mounted on the frame such that it can rock; and at least one damping element located on at least one of the frame and the operating member, the damping element serving as a sound dampening bumper between the operating member and the frame, and wherein the damping element is attached to at least one of the frame and the operating member by being partially inserted into a recess, the damping element having a first cross section and a second cross section at right angles to the first cross section, the first cross section having an I-shape and the second cross section having a step-shape with successively reduced cross-section, and the recess is arranged to correspond approximately to the cross section shapes for gripping the damping element.

15. The electrical switch arrangement as disclosed in claim 14, wherein the frame is approximately rectangular and includes two opposite and substantially parallel longitudinal sides, the longitudinal sides each having a middle;

two opposite and substantially parallel transverse sides, the transverse sides each having a middle;

two bearing pins, the bearing pins each arranged approximately in the middle of each of the longitudinal sides, for rockably mounting the operating member; and wherein at least one of the damping elements is located at approximately the middle of each of the transverse sides.

16. An electrical switch arrangement comprising:

a housing;

a plurality of electrical switches arranged in the housing; a switch comprising:

a switching module, including a contact system;

a frame;

an operating member for switching the contact system and arranged as a rocker and pivotally mounted on the frame such that the operating member can rock; and at least one damping element located on at least one of the frame and the operating member, the damping element serving as a sound dampening bumper between the operating member and the frame, wherein the damping element is a solid element attached to at least one of the frame and the operating member by being partially inserted into a recess, and the damping element includes at least one projection formed as a spike and located on an upper part of the damping element that projects from the recess, the at least one projection being easily deformed to initially brake the operating member before the operating member comes to rest against the upper part of the damping element where the operating member is subsequently damped.

17. The electrical switch arrangement as disclosed in claim 16, wherein the frame is approximately rectangular and includes two opposite and substantially parallel longitudinal sides, the longitudinal sides each having a middle;

two opposite and substantially parallel transverse sides, the transverse sides each having a middle;

two bearing pins, the bearing pins each arranged approximately in the middle of each of the longitudinal sides, for rockably mounting the operating member; and wherein at least one of the damping elements is located at approximately the middle of each of the transverse sides.

* * * * *